US006338652B1

(12) United States Patent
Ko

(10) Patent No.: US 6,338,652 B1
(45) Date of Patent: Jan. 15, 2002

(54) LOW PROFILE CABLE CONNECTOR WITH GROUNDING MEANS

(75) Inventor: David Tso-Chin Ko, Thousand Oaks, CA (US)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 09/611,233

(22) Filed: Jul. 6, 2000

Related U.S. Application Data

(63) Continuation-in-part of application No. 09/578,349, filed on May 24, 2000, and a continuation-in-part of application No. 09/350,942, filed on Jul. 9, 1999, now Pat. No. 6,139,363.

(51) Int. Cl.[7] ..... H01R 9/05
(52) U.S. Cl. ..... 439/579; 439/497
(58) Field of Search ..... 439/579, 610, 439/497

(56) References Cited

U.S. PATENT DOCUMENTS 4,169,650 A * 10/1979 Schweizer ..... 439/579
4,365,856 A * 12/1982 Yaegashi et al. ..... 439/579
4,379,608 A * 4/1983 Olsson et al.
4,550,971 A * 11/1985 Gentric ..... 439/697
4,602,832 A * 7/1986 Cunningham et al. ..... 439/579
4,682,840 A * 7/1987 Lockard ..... 439/874
4,781,620 A * 11/1988 Tengler et al. ..... 439/497
4,993,968 A * 2/1991 Guletsky et al. ..... 439/579
5,026,304 A * 6/1991 Furrow ..... 439/695
5,085,596 A * 2/1992 Bowen et al. ..... 439/497
5,241,135 A * 8/1993 Fetzer ..... 439/579
5,871,369 A * 2/1999 Ohayashi et al.
5,980,308 A * 11/1999 Hu et al. ..... 439/579
6,024,597 A * 2/2000 Lok ..... 439/497
6,027,367 A * 2/2000 Woertz et al. ..... 439/497

* cited by examiner

*Primary Examiner*—Gary F. Paumen
*Assistant Examiner*—James Harvey
(74) *Attorney, Agent, or Firm*—Wei Te Chung

(57) ABSTRACT

A cable connector assembly (100) includes a cable connector (1) and a coaxial multiconductor cable set (40). The cable set (40) includes a grounding bar (50) electrically connected to braidings shielding each coaxial connector in each wire (401) of the cable set (40). The cable connector (1) comprises a housing (10), an insert (20) with a number of terminals (22), a grounding plate (30), and a shield (60) surrounding the housing. The cable set (40) is connected to the insert (20), the conductors (424) soldered to the terminals (22) and the grounding bar (50) mating with the insert (20). The housing (10) includes a front wall (14), a pair of sidewalls (13), and a top wall (12) with an opening (15) defined therebetween. A bottom side (217) of the insert (20) acts as a bottom wall of the housing (10) thereby reducing the profile of the cable connector (1). The grounding plate (30) has a number of grounding pads (35) and a pair of arms (33) extending from opposite ends of a strip (31) thereof. The grounding plate (30) is easily insertable between the housing (10) and the insert (20), whereby the arms (33) contact the grounding bar (50) engaged with the insert (20). The shield (60) provides a pair of fingers (62) pressing against the arms (33) of the grounding plate (30), thereby establishing a grounding path between the shield (60), the grounding plate (30), the grounding bar (50) and the braidings.

1 Claim, 8 Drawing Sheets

LOW PROFILE CABLE CONNECTOR WITH GROUNDING MEANS

RELATED APPLICATIONS

This application is a continuation-in-part application of the application Ser. No. 09/578,349 filed May 24, 2000, and a continuation-in-part application of the application Ser. No. 09/350,942 filed Jul. 9, 1999 now U.S. Pat. No. 6,139,363.

BACKGROUND OF THE INVENTION

1. Field of the Invention

The present invention relates to a low profile connector for terminating a flat ribbon coaxial multiconductor cable, and particularly to a low profile connector with a modular insert subassembly and a grounding device that is easy to assemble and which establishes a grounding path between a grounding bar attached to the coaxial multiconductor cable and a shield of the connector.

2. Brief Description of the Prior Art

It is well known by those skilled in the art that, particularly for high frequency communication, a coaxial cable connector is required to terminate a coaxial multiconductor cable in order to minimize crosstalk between constituent coaxial conductors. Grounding means is required in such a connector to ground the braided coaxial conductor shields.

As disclosed in U.S. Pat. No. 4,781,620, a conventional flat ribbon coaxial multiconductor cable connector provides a grounding bus which connects with the coaxial braidings which shield component conductors of the coaxial multiconductor cable. The grounding bus is further connected to grounding contacts of the connector, thereby preventing crosstalk between the conductors. However, the connector is difficult to assemble because the grounding bus has to be soldered to the coaxial braiding of each conductor and to the grounding contacts. The soldering process makes assembly more complicated than a simple mechanical engagement between the grounding bus and the grounding contacts. Furthermore, the grounding bus and the grounding contacts are partially insert molded in a carrier housing. The housing must be thick enough to protect the contacts from damage, which results in a connector having large dimensions. Moreover, U.S. Pat. No. 4,781,620 provides no outer shield and thus does indicate an electrical connection between the shield around the connector.

Hence, an improved electrical connector is required to overcome the disadvantages of the prior art.

BRIEF SUMMARY OF THE INVENTION

A first object of the present invention is to provide a flat ribbon coaxial multiconductor cable connector with a grounding means which is easy to assemble;

A second object of the present invention is to provide a low profile flat ribbon coaxial multiconductor cable connector;

A third object of the present invention is to provide a flat ribbon coaxial multiconductor cable connector which has a shield electrically mating with a grounding means interior to the cable connector to establish a grounding path therebetween.

To achieve the above-mentioned objects, a cable connector for terminating a coaxial multiconductor cable set includes a housing, a conductive shield surrounding the housing, an insert incorporating a plurality of terminals therein, and a grounding plate fixed between the housing and the insert.

The coaxial multiconductor cable set comprises a plurality of wires and a grounding bar electrically connected to a length of bared braiding of each wire.

The housing provides a body and a mating tongue extending forwardly from the body. The body includes a front wall, a pair of sidewalls, and a top wall, together defining an opening therebetween. A pair of opposite notches is defined in the top wall. The mating tongue defines a plurality of depressions and passageways respectively in opposite sides thereof in communication with the opening.

The shield has a pair of fingers stamped in an upper surface thereof.

The insert comprises an insulative base from which the conductive terminals project forwardly in a row. A groove is defined along a length of the base for inserting the grounding bar of the cable set into, thereby forming a subassembly of the insert and the coaxial multiconductor cable set. A plurality of recesses are formed in the base and intersecting the groove. Each wire is received in a respective recess and connects with a corresponding terminal.

The grounding plate provides a plurality of grounding pads extending forward from a strip thereof and a pair of arms extending rearward from the strip.

During assembly, the shield is first mounted to the housing. The grounding plate is then simultaneously inserted into the housing with the subassembly of the insert and the coaxial multiconductor cable set so that the grounding pads of the grounding plate extend into corresponding depressions of the housing and the terminals of the insert extend into corresponding passageways of the housing. The arms of the grounding plate are located above the insert, thereby allowing for engagement with the grounding bar secured in the insert. The fingers of the shield protrude through the notches of the top wall of the housing to contact the arms of the grounding plate, thereby establishing an electrical path from the shield to the grounding bar via the grounding plate. In addition, a bottom side of the insert is coplanar with a bottom side of the sidewalls of the housing, thereby functioning as a bottom wall of the housing. Therefore, the height of the cable connector is minimized.

Other objects, advantages and novel features of the present invention will become more apparent from the following detailed description of the present embodiment when taken in conjunction with the accompanying drawings.

DETAILED DESCRIPTION OF THE INVENTION

Figure 1:
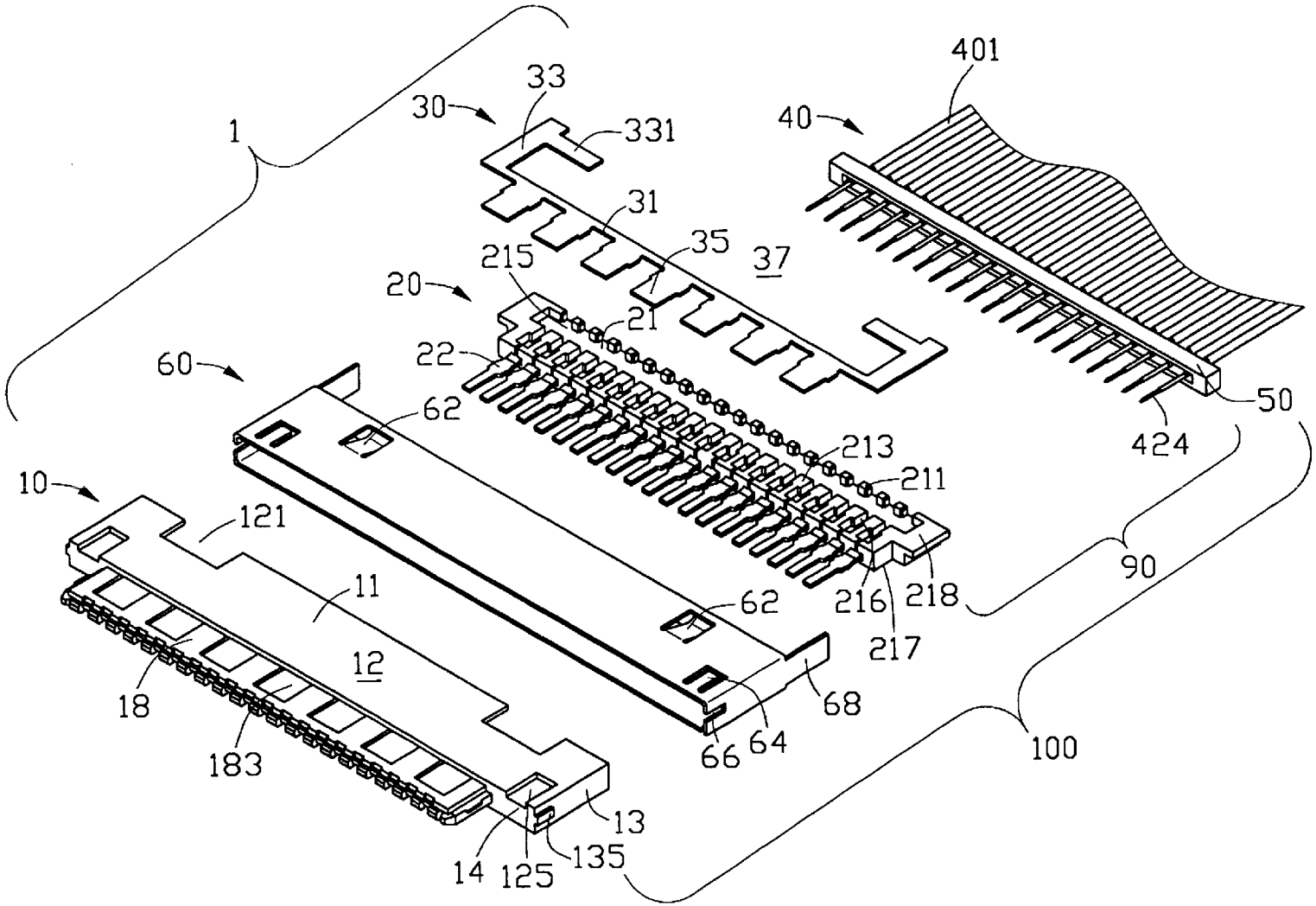
FIG. 1 is an exploded view of an electrical cable connector with a cable set in accordance with a first embodiment of the present invention.

Referring to FIG. 1, a cable connector assembly 100 of the present invention includes an electrical cable connector 1 and a flat ribbon coaxial multiconductor cable set 40. The cable connector 1 comprises a dielectric housing 10, a conductive shield 60 for shielding the housing 10, a metal grounding plate 30, and an insert 20 incorporating a plurality of conductive terminals 22 therein.

The coaxial multiconductor cable set 40 consists of a plurality of wires 401 and a conductive grounding bar 50. Each wire 401 includes a core conductor 424 which is shielded by a braiding 420 (see FIGS. 4 and 6). A layer of insulation (not labeled) isolates the core conductor 424 from the respective braiding 420. The grounding bar 50 electrically connects with the braidings 420. Each wire 401 is striped at a distal end thereof to expose a length of the braiding 420 and a separate length of the core conductor 424. Details of the cable set 40 are disclosed in a U.S. application titled "MICRO CONNECTOR ASSEMBLY AND THE METHOD OF MAKING THE SAME", which was filed on Jul. 9, 1999 and has an application Ser. No. 09/350,942. The Ser. No. 09/350,942 application is incorporated herein by reference.

Figure 2:
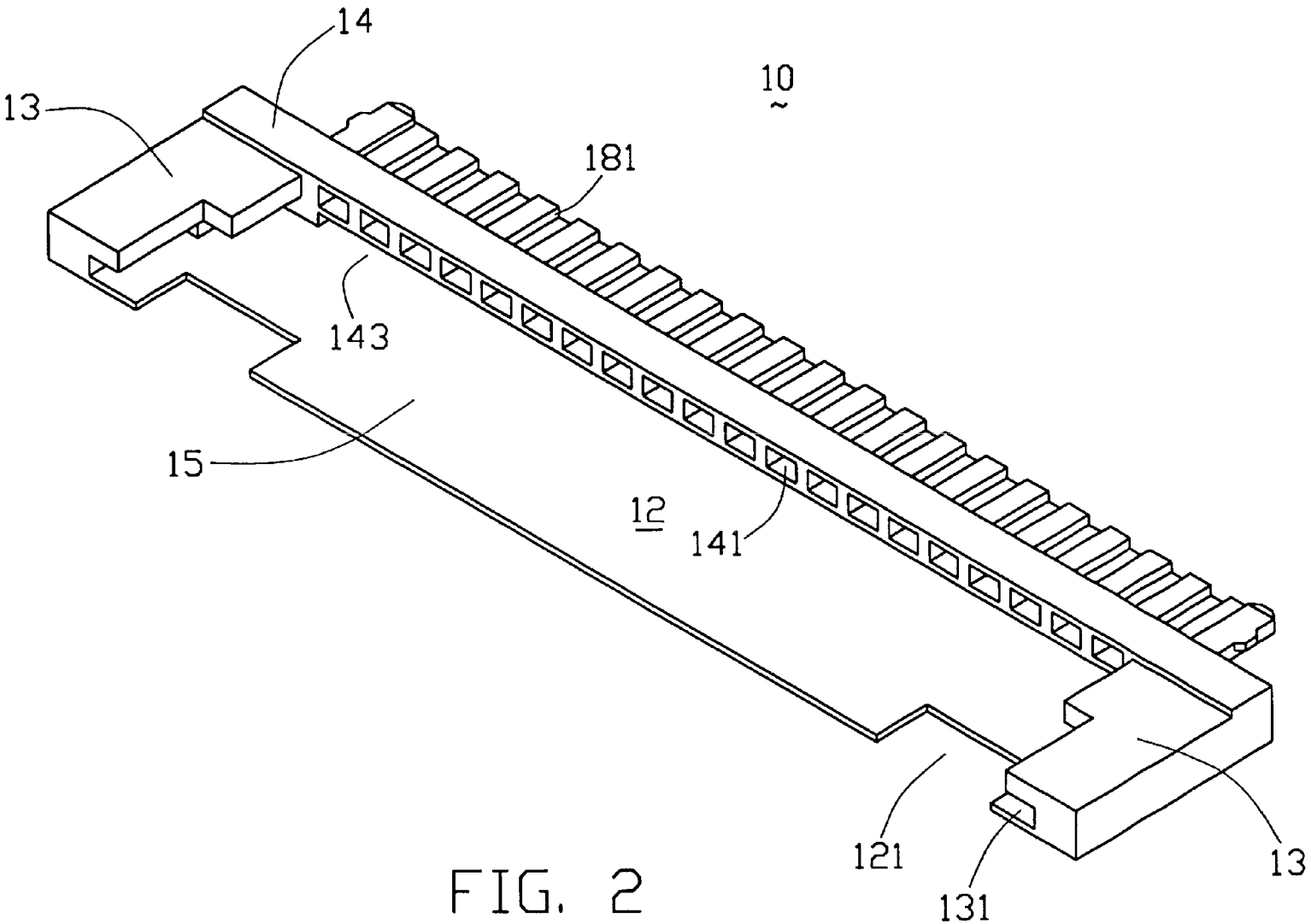
FIG. 2 is a perspective view of a bottom of a housing of the cable connector of FIG. 1.

The housing 10, further referring to FIG. 2, consists of an elongate body 11 and a mating tongue 18 extending forward from a front end of the body 11. The body 11 includes a top wall 12, a pair of sidewalls 13, and a front wall 14, with an opening 15 defined therebetween for accommodating the insert 20 and the grounding plate 30. The top wall 12 has a pair of notches 121 in a rear edge proximate the sidewalls 13. A step-shaped channel 131 is defined in an inner side of each sidewall 13 in communication with the opening 15. The front wall 14 defines a plurality of holes 141 therethrough, each in communication with a corresponding passageway 181 defined in a lower side of the mating tongue 18 for extensions of the terminals 22. A slit 143 is further defined in the front wall 14 in communication with the opening 15 and a plurality of depressions 183 defined in an upper side of the mating tongue 18. A pair of indents 125 and blocks 135, as shown in FIG. 1, is provided respectively on the top wall 12 and on the sidewalls 13 of the housing 10.

The shield 60 provides a pair of fingers 62 stamped downwardly from a top side thereof. Each finger 62 forms an arcuate free end for resiliently and reliably pressing against the grounding plate 30. A pair of cutouts 66 is defined in lateral sides of the shield 60, and a pair of tongues 64 is stamped in the top side of the shield 60 proximate to corresponding cutouts 66. A pair of tails 68 respectively extends from lateral rear edges of the shield 60 for latching the shield 60 to the housing 10.

The insert 20 includes an elongate dielectric base 21, from which the conductive terminals 22 forwardly extend in a row. The base 21 forms a row of projections 211 and a row of ribs 213 on an upper side thereof. Each projection 211 aligns with a rib 213 in a rear to front direction, whereby a recess 216 is defined between neighboring projections 211 and ribs 213. A groove 215 lengthwise extends between the rows of projections 211 and ribs 213 and intersects the recesses 216 for receiving the grounding bar 50 of the coaxial multiconductor cable set 40 therein. The terminals 22 are arranged to align with and are exposed at respective recesses 216. Step-shaped flanges 218 are formed on lateral sides of the base 21 of the insert 20.

The grounding plate 30, in a first embodiment shown in FIG. 1, has an elongate strip 31, a pair of L-shaped arms 33 extending rearward from opposite ends of the strip 31, and a plurality of grounding pads 35 extending forward from a front edge of the strip 31 at equal intervals. The grounding plate 30 is preferably planar. Each arm 33 has a contacting section 331 parallel to the strip 31 and defines a space 37 between the contacting section 331 and the strip 31. It is noted that the space 37 is designed for preventing the bared core conductors 424 from inadvertently engaging with the grounding plate 30 when debris is carelessly left between the ribs 213, which would cause a short circuit between the bared core conductors 424 and the grounding plate 30. An embossment 332 is formed on an underside of each contacting section 331.

The coaxial multiconductor cable set 40 is adapted to be assembled to the insert 20 to provide a subassembly 90 such that each wire 401 is retained in a corresponding recess 216 and each core conductor 424 is soldered to a corresponding terminal 22. The grounding bar 50 fits in the groove 215 of the base 21.

In assembly, the shield 60 is first mounted to enclose the housing 10 from a rear end of the housing 10 to a position where the tongues 64 and the cutouts 66 of the shield 60 respectively mate with the indents 125 and the blocks 135 of the housing 10. The grounding plate 30 and the subassembly 90, which consists of the insert 20 and the coaxial multicondutor cable set 40, are simultaneously inserted into the opening 15 of the housing 10, the grounding plate 30 being above the subassembly 90, so that the terminals 22 of the insert 20 extend through the holes 141 into corresponding passageways 181, the grounding pads 35 of the grounding plate 30 extend through the slit 143 into the depressions 183 of the mating tongue 18, and the fingers 62 of the shield 60 press against the contacting sections 331 of the grounding plate 30 through the notches 121 of the housing 10. Finally, the tails 68 of the shield 60 are inwardly bent to retain the insert 20 and the grounding plate 30 in the opening 15.

Figure 3:
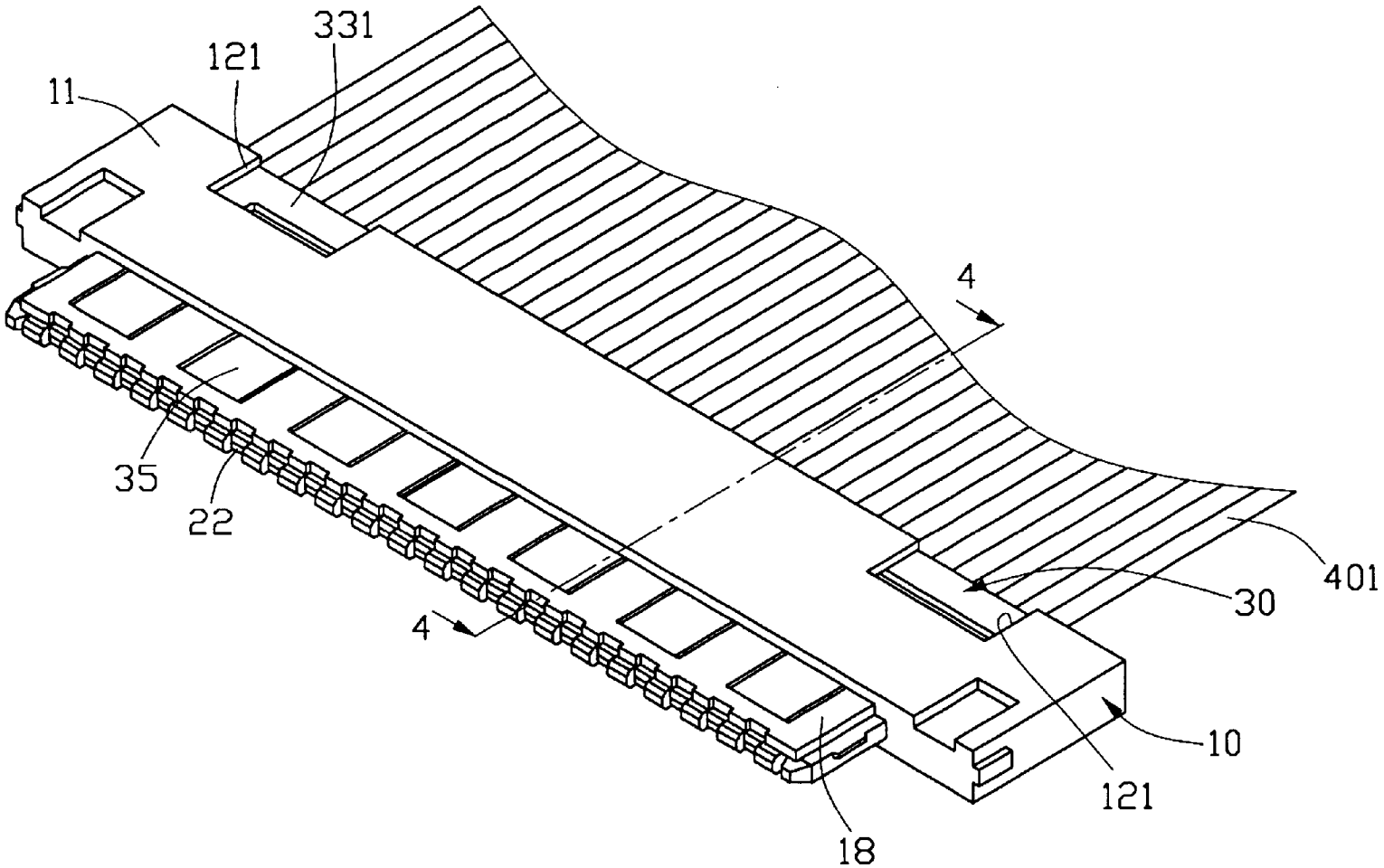
FIG. 3 is a partially assembled view of the cable connector of FIG. 1.
Figure 4:
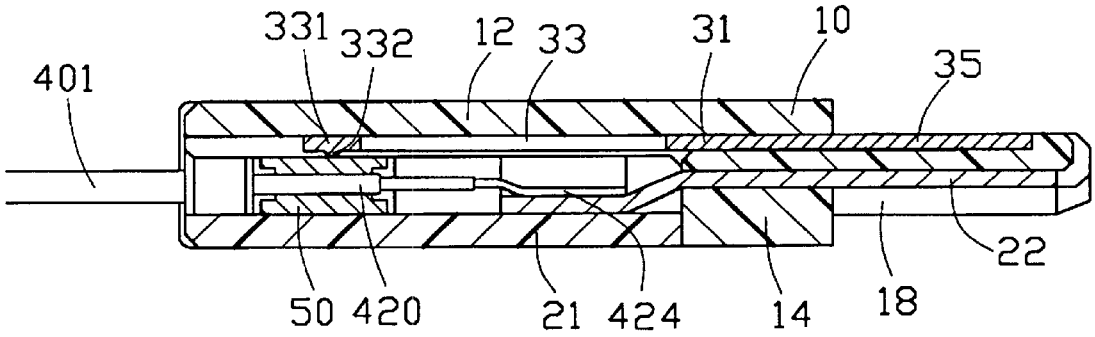
FIG. 4 is a cross-sectional view taken along line 4—4 of FIG. 3.

FIGS. 3 and 4 clearly show an engagement between the grounding plate 30, the insert 20, and the housing 10, the shield 60 being removed for simplicity. The grounding pads 35 extend into the depressions 183 of the mating tongue 18 for connection with grounding pins of a mating connector (not shown), and the arms 33 of the grounding plate 30 lie against the top wall 12 and the contacting sections 331 are received beneath corresponding notches 121. Lateral front edges of the strip 31 of the grounding plate 30 abut against lateral rear sides of the front wall 14 of the housing 10 for positioning the grounding plate 30 in proper position. At the same time, the grounding plate 30 is positioned over the insert 20 such that the embossments 332 formed on the underside of the contacting sections 331 are brought into electrical connection with the grounding bar 50 fixed in the insert 20. A grounding path from the braidings 420 of respective wires 401 through the grounding bar 50 to the grounding plate 30 is thus established to ground the braidings of the coaxial multiconductor cable set 40 to an external ground circuit. Since the grounding plate 30 is facilely inserted into the housing 10, rather than insert molded, the assembly of the connector 1 is less complicated and less expensive.

Moreover, the flanges 218 of the insert 20 are fixed in the channels 131 of the sidewalls 13 while a bottom side 217 of the insert 20 flushes with bottom sides of the sidewalls 13. The flat bottom side 217 of the insert 20 thus acts as the bottom of the housing 10, thereby reducing the height of the cable connector 1.

Figure 5:
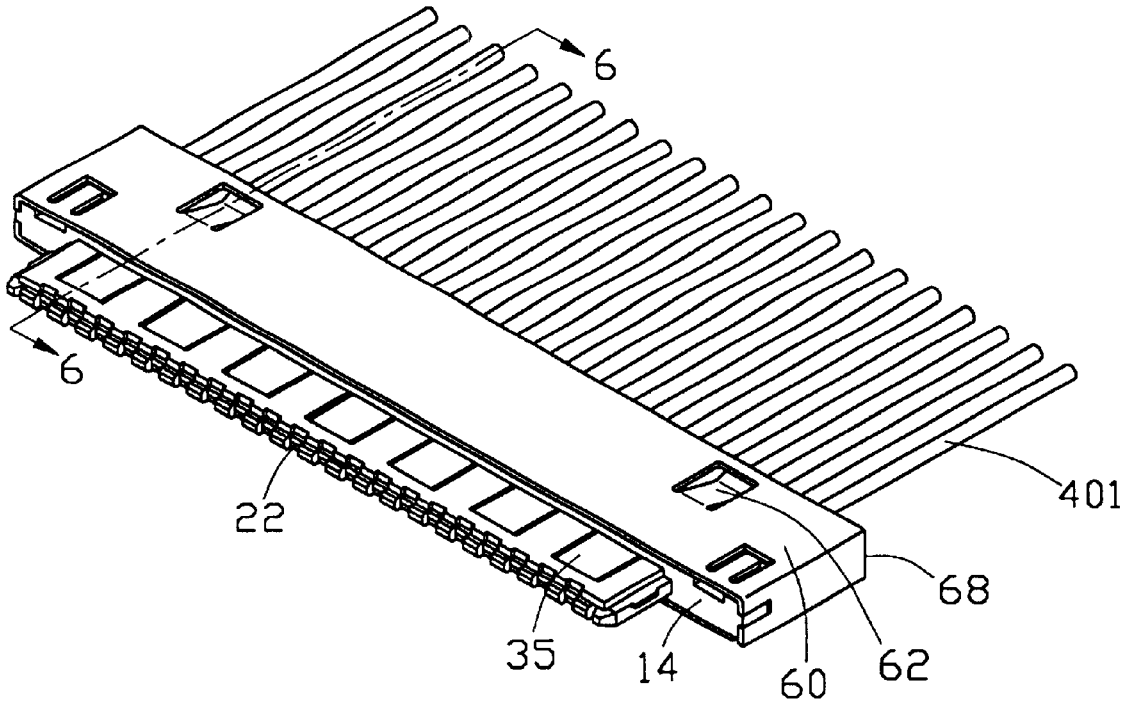
FIG. 5 is an assembled view of FIG. 1.
Figure 6:
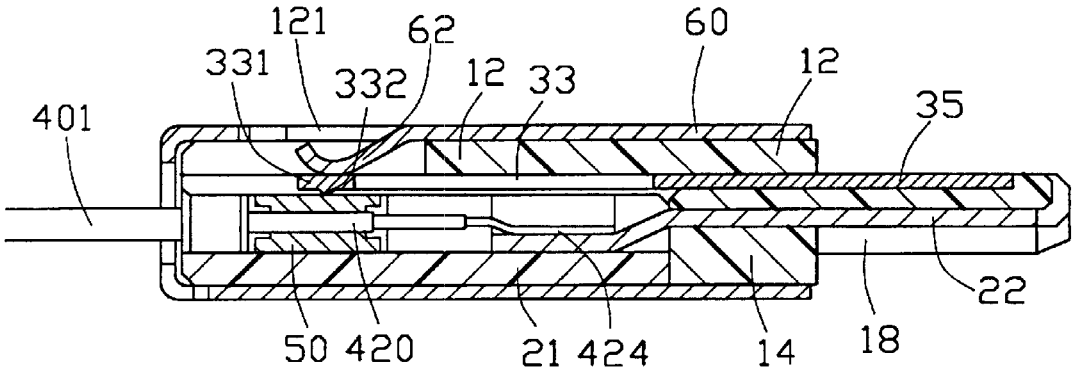
FIG. 6 is a cross-sectional view taken along line 6—6 of FIG. 5.

FIGS. 5 and 6 show the shield 60 enclosing the housing 10. The fingers 62 of the shield 60 protrude through the notches 121 of the housing 10 to electrically and mechanically contact with the contacting sections 331 of the arms 33 of the grounding plate 30. The shield 60 is, therefore, grounded through the grounding plate 30 with the grounding bar 50 and the braidings 420 of the wires 401.

Figure 7:
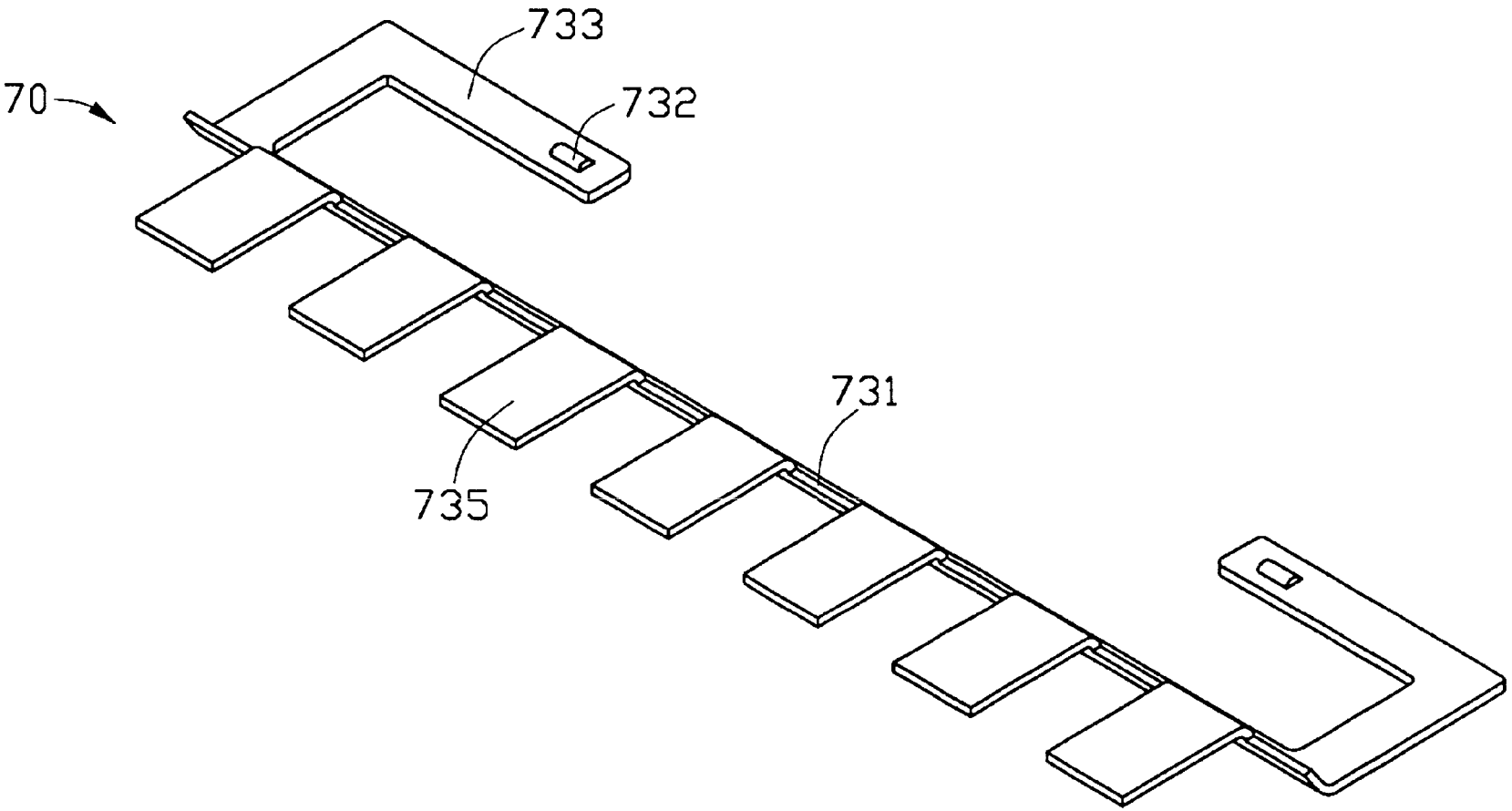
FIG. 7 is a perspective view of a bottom of a grounding plate in accordance with a second embodiment of the present invention.

FIG. 7 shows a perspective view of a bottom of a grounding plate 70 in accordance with a second embodiment, which includes an inclined strip 731, a pair of arms 733 projecting rearward respectively from opposite ends of the strip 731, and a plurality of grounding pads 735 forward extending from a front edge of the strip 731 at equal intervals. The strip 731 interconnects the arms 733 with the grounding pads 735. Like the first embodiment, each arm 733 provides an embossment 732 on an underside thereof for reliably engaging with the grounding bar 50 when the grounding plate 70 is mounted between the insert 20 and the housing 10.

Figure 8:
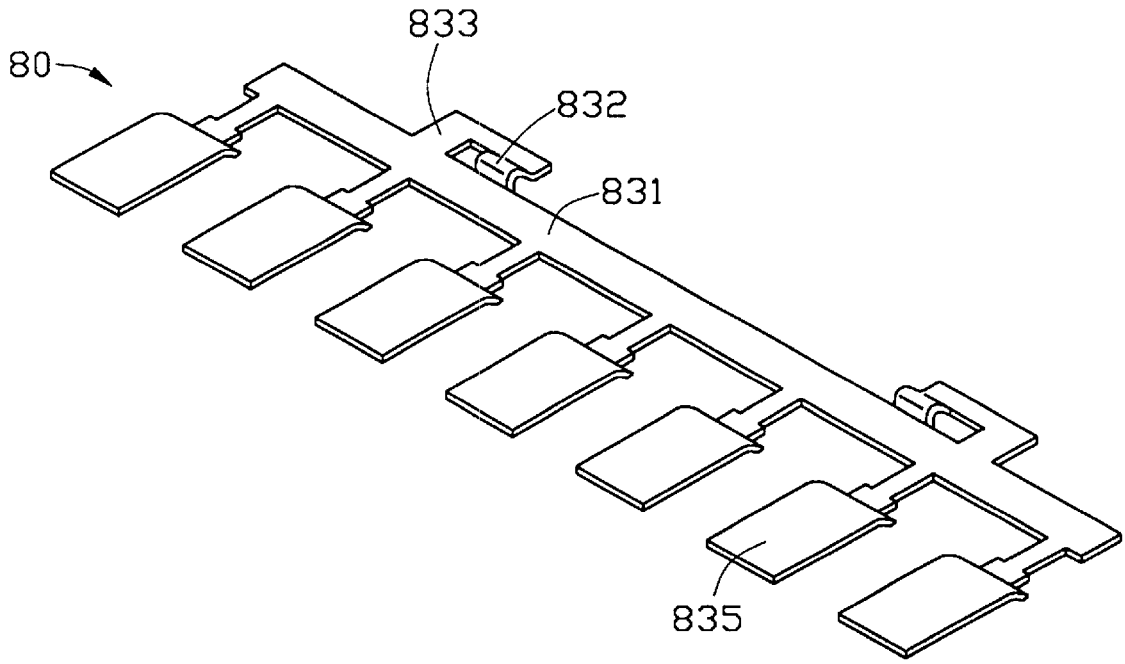
FIG. 8 is a perspective view of a bottom of a grounding plate in accordance with a third embodiment of the present invention.

In a third embodiment shown in FIG. 8, the grounding plate 80 provides a pair of arms 833 and a plurality of grounding pads 835 respectively extending from opposite edges of a strip 831. A protrusion 832 connects a free end of each arm 833 with the strip 831 for touching the grounding bar 50 when the grounding plate 80 is mounted between the insert 20 and the housing 10.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An electrical cable connector for connecting a flat ribbon coaxial multiconductor cable set with a mating connector, the flat ribbon coaxial multiconductor cable set having a flat ribbon coaxial multiconductor cable with a length of its core conductors and associated braidings bared and a conductive grounding bar electrically connected to the braidings, comprising:

an insulative housing having a body including a front wall, a pair of sidewalls, a top wall, and an opening therebetween, and a mating tongue extending forwardly from the front wall and defining in one side thereof a plurality of depressions communicating with the opening;

an insert including a dielectric base received in the opening and a plurality of conductive terminals secured to the base, the grounding bar of the coaxial multiconductor cable set being fit in the insert and the terminals electrically connecting with corresponding core conductors of the coaxial multiconductor cable set; and a conductive grounding member received in the opening of the housing and including a mating portion and a contacting portion, the contacting portion contacting with the grounding bar, the mating portion extending into the depressions in the mating tongue for connection with an external grounding circuit of the mating connector;

wherein the grounding member defines a space between the contacting portion and the mating portion, the space functioning to avoid inadvertent short circuits between the core conductors and the grounding member;

wherein the contacting portion provides an embossment on a free end thereof for engaging with the grounding bar;

wherein the housing defines at least a notch in the top wall thereof corresponding to the location of the contacting portion;

further comprising a metal shield enclosing the housing, the shield providing at least a finger extending through the notch for touching with the contacting portion of the grounding member thereby establishing an electrical connection with the grounding member and the grounding bar;

wherein a bottom side of the base is coplanar with a bottom side of the sidewalls of the housing whereby the bottom side of the base acts as a bottom wall of the housing and a height of the housing is thus reduced.

* * * * *